US007830321B2

(12) United States Patent
Fukuchi

(10) Patent No.: US 7,830,321 B2
(45) Date of Patent: Nov. 9, 2010

(54) ANTENNA FOR ULTRA WIDE BAND TELECOMMUNICATIONS

(75) Inventor: Keisuke Fukuchi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 311 days.

(21) Appl. No.: 11/688,597

(22) Filed: Mar. 20, 2007

(65) Prior Publication Data

US 2007/0222694 A1 Sep. 27, 2007

(30) Foreign Application Priority Data

Mar. 23, 2006 (JP) ..... 2006-080711

(51) Int. Cl.
*H01Q 13/10* (2006.01)

(52) U.S. Cl. ..... 343/767

(58) Field of Classification Search ..... 343/767, 343/770, 702, 817, 818, 795, 846
See application file for complete search history.

(56) References Cited

U.S. PATENT DOCUMENTS 6,762,729 B2 * 7/2004 Egashira ..... 343/767
6,914,573 B1 * 7/2005 McCorkle ..... 343/767
7,352,333 B2 * 4/2008 McCorkle ..... 343/767
2006/0033670 A1 * 2/2006 Schadler ..... 343/767
2006/0055619 A1 * 3/2006 Sarabandi et al. ..... 343/866

FOREIGN PATENT DOCUMENTS

JP 2004-343424 12/2004
JP 2005-094437 4/2005
JP 2005-094499 4/2005

OTHER PUBLICATIONS

Kai Chang; Microwave and Optical Technology Letters; Print ISSN: 0895-2477; Online 1098-2760 at Wiley InterScience, www.interscience.wiley.com; May 5, 2000; p. 205-211; vol. 25 / No. 3.

* cited by examiner

*Primary Examiner*—Hoang V Nguyen
*Assistant Examiner*—Robert Karacsony
(74) *Attorney, Agent, or Firm*—Antonelli, Terry, Stout & Kraus, LLP.

(57) ABSTRACT

An antenna for an ultra wide band telecommunications, provided with a rectangular conductive plate where a bow tie slot is formed, an auxiliary element extended from said rectangular conductive plate above one of two vertical angle parts opposed at a center part of the bow tie slot, a feeding part formed at one of the vertical angle parts, and a grounding part formed at the other vertical angle part.

15 Claims, 4 Drawing Sheets

ANTENNA FOR ULTRA WIDE BAND TELECOMMUNICATIONS

BACKGROUND OF THE INVENTION

The present invention relates to an antenna, especially to an antenna applicable for UWB (Ultra Wide Band) telecommunications equipment that is a super high-speed communication method in the next generation.

High-speed communication more than an optical fiber becomes possible by using UWB in Wireless. UWB is expected as a communication method which takes the place of wireless LAN in which present 5 GHz band (IEEE 802.11a), etc. are used or Bluetooth (registered trademark) which uses 2.4 GHz band.

UWB is a communication method where high-speed data transmission of 100 M to 1 G/bps is achieved by using wide-multiband from 3.1 to 10.6 GHz. Wide-band than ever is required in the antenna used for this communication.

At this time, it is almost decided that the frequency band of 3-5 GHz is used for the initial stage UWB communication. In addition, it is hoped that the UWB communication covers the frequency band of 2.3-6 GHz when using such as Wireless LAN together is considered.

As the conventional antenna for UWB, various kinds of antennas are proposed. For example, there are an antenna in which a conductor of a home base shape is placed between dielectric substance, and the top part of a baseball shape is grounded through a power supply as is disclosed in Japanese Patent Laid-Open No. 2005-94437, an improved Sierpinski type antenna as is disclosed in Japanese Patent Laid-Open No. 2004-343424, and an improved patch antenna as is disclosed in Japanese Patent Laid-Open No. 2005-94499.

SUMMARY OF THE INVENTION

A small and thin type antenna, which can cover the wide-band of 2.3-6 GHz and has 50% or more in specific band, is not achieved yet.

An object of the present invention is to provide an antenna, which can cover broadband, improve a VSWR characteristic of the specific wavelength, and further increase antenna gain.

To achieve the above-mentioned object, an antenna according to one aspect of the present invention is provided with a rectangular conductive plate, a bow tie slot formed in the rectangular conductive plate, an auxiliary element extended from the rectangular conductive plate above one of two vertical angle parts opposed at a center part of the bow tie slot, a feeding part formed at one of the vertical angle parts, and a grounding part formed at the other vertical angle part.

Preferably, the auxiliary element is formed so as to rise up vertically around the center of upper side of conductive plate, and extend along upper side with a constant space being kept.

Preferably, the rectangular conductive plate, the bow tie slot and the auxiliary element are formed by stamping out a metallic plate.

Preferably, the antenna further includes an auxiliary antenna element extended along the bow tie slot, which is formed on the side of at least one of vertical angle parts that oppose at the center part of the bow tie slot.

An antenna according to another aspect of the present invention is provided with a rectangular conductive plate slot formed in the rectangular conductive plate, a notch slit formed from the slot to a vertical side of the rectangular conductive plate, a feeding part formed at one side of the notch slit, an auxiliary element formed on an upper side of the conductive plate in which the feeding part is formed, and a grounding part formed at the other side of the notch slit.

Preferably, in an antenna according to another aspect of the present invention, the slot is formed like diamond or taper, and located on the side of the upper side of the rectangular conductive plate, and a grounding part is formed on the side of the lower side of the rectangular conductive plate.

Preferably, in an antenna according to another aspect of the present invention, the auxiliary element is formed so as to rise up vertically at an end portion of the upper side on the side of the feeding part, and extend along upper side of the conductive plate with a constant space being kept.

Preferably, in an antenna according to another aspect of the present invention, the auxiliary element is formed in the upper side part of the conductive plate by forming a hooked notch slit substantially from the center part of the upper side of the conductive plate toward a vertical side on the side where the feeding part is formed.

Preferably, in an antenna according to another aspect of the present invention, an auxiliary antenna element extended along the slot is formed on one of the sides of the notch slit.

In the present invention, the independent arbitrary resonance can be provided to the resonance with a bow tie slot antenna.

BRIEF DESCRIPTION OF THE INVENTION

DETAILED DESCRIPTION OF THE PREFERRED EMBODIMENTS

An embodiment of the present invention will be explained hereinafter with reference to the attached drawings.

Figure 1:
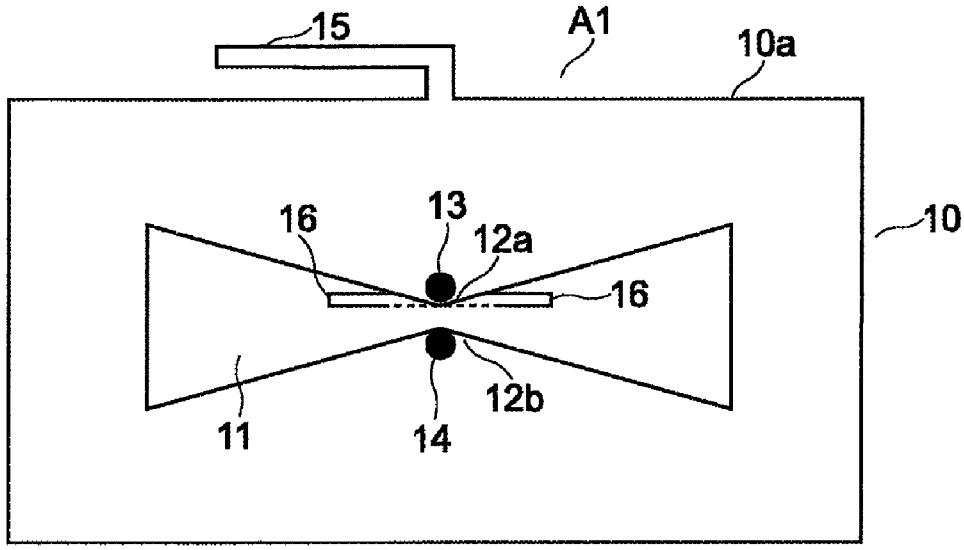
FIG. 1 is a schematic view showing the structure of an antenna according to one embodiment of the present invention.
Figure 2:
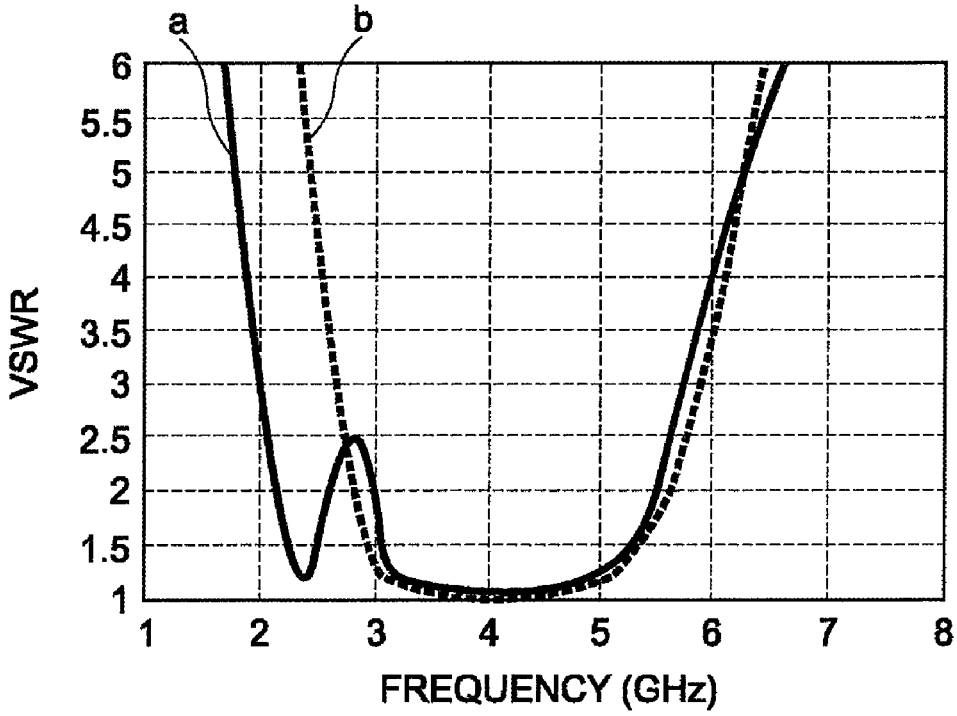
FIG. 2 is a graph showing a VSWR characteristic of the antenna shown in FIG. 1.

FIG. 1 and FIG. 2 illustrate one embodiment of antenna A1 of the present invention. FIG. 1 shows the shape of the antenna A1, and FIG. 2 shows a VSWR (Voltage Standing Wave Ratio) characteristic of the antenna A1.

In FIG. 1, numeral 10 designates a rectangular conductive plate having a major planar side bounded by multiple minor edges or sides, made by punching out a metallic plate of 0.1-0.5 mm in thickness with a pressing machine. Bow tie slot 11 is formed in this rectangular conductive plate 10 by press-punching.

Bow tie slot 11 formed in rectangular conductive plate 10 has the shape formed by opposing top parts of two isosceles triangles and connecting to each other as shown in the figure.

Feeding part 13 is formed at vertical angle part 12*a* which is one of vertical angle parts that oppose at the center part of this bow tie slot 11, and grounding part 14 is formed at the other vertical angle part 12*b*.

Auxiliary element 15 extended from conductive plate 10 is formed above upper side 10*a* of this conductive plate 10 on the side of the feeding part.

Auxiliary element 15 is formed so as to rise up vertically around the center of upper side 10*a* of conductive plate 10, and then extend along upper side 10*a* with a constant space being kept.

Further, it is possible to form auxiliary antenna elements 16 which oppose to each other at the center part of bow tie slot 11 and extend along the long direction of bow tie slot 11 on both sides of vertical angle part 12*a* as shown by dashed lines. Moreover, this auxiliary antenna element 16 may be formed on either side though it is formed on both sides of vertical angle part 12*a* in FIG. 1.

Feeding part 13 and grounding part 14 are connected to a signal generation module or an inspection device through a coaxial cable (not shown).

Figure 3:
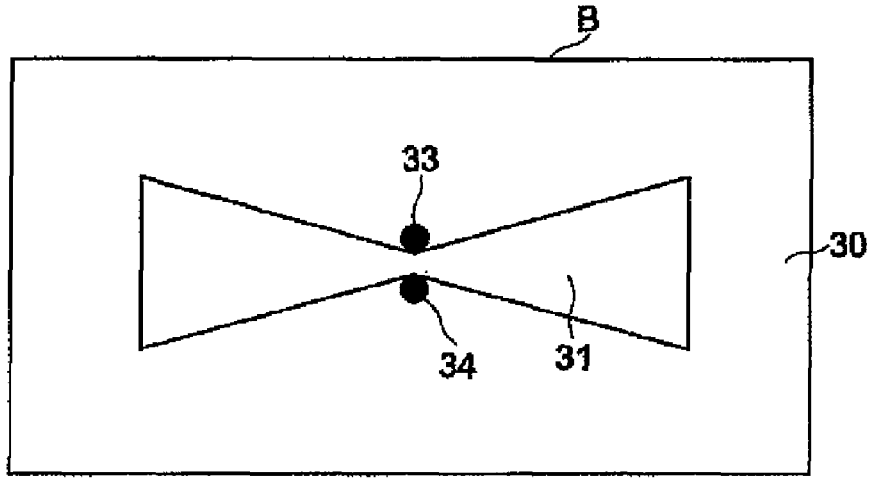
FIG. 3 PRIOR ART
FIG. 3 is a schematic view showing a conventional bow tie slot antenna.
Figure 4:
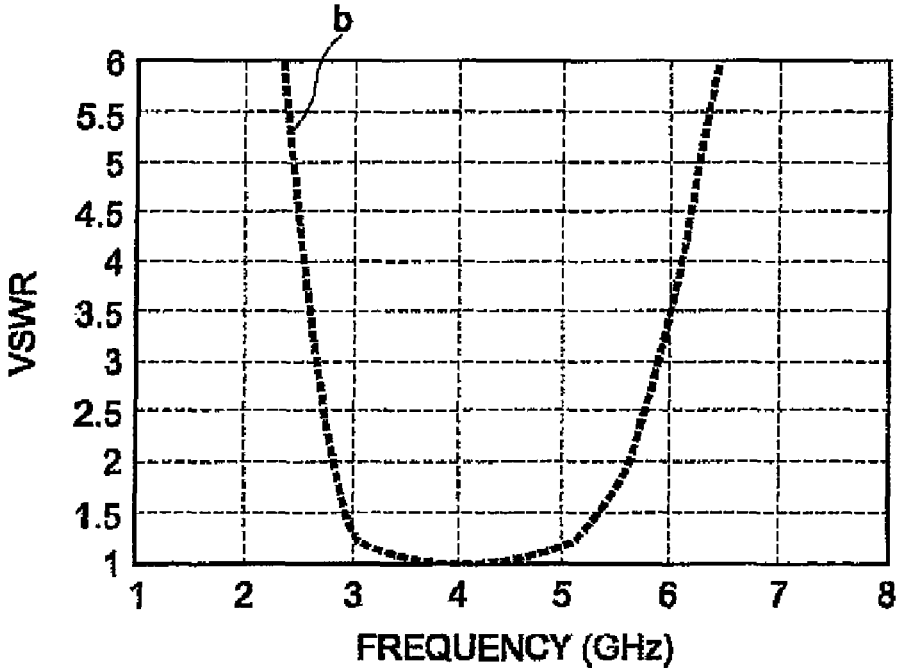
FIG. 4 PRIOR ART
FIG. 4 is a graph showing a VSWR characteristic of a conventional bow tie antenna shown in FIG. 3.

Next, the difference between antenna A1 of the present invention and conventional bow tie slot antenna B shown in FIG. 3 and FIG. 4, and a VSWR characteristic are explained.

In general, bow tie slit (or slot) 31 is formed in metallic plate 30 which forms a grounding board as shown in FIG. 3 in bow tie slot antenna B. And, feeding part 33 and grounding part 34 where an electric power is fed are formed on a metallic surface at vertical angle parts where slit 31 has narrowed most.

The VSWR characteristic of this bow tie slot antenna B shows unfavorable characteristic in 2.3-2.7 GHz band though it shows favorable characteristic in 3-5.5 GHz band as shown in FIG. 4.

It is possible to change the VSWR characteristic from characteristic b shown by the dotted line in FIG. 4 to characteristic a shown by the solid line in FIG. 1 by providing auxiliary element 15 shown in FIG. 1.

That is, a new resonance peak can be given to 2.3-2.7 GHz band by adding auxiliary element 15.

The frequency of this resonance peak can change independent of the resonance frequency with the bow tie antenna by changing the length of auxiliary element 15.

This auxiliary element 15 functions as a $\lambda/4$ element in resonance frequency c given by resonance frequency $fc=c/\lambda c$ (c is a velocity of light).

For instance, when a new resonance peak is added to 2.4 GHz band, length L of the element is $L=c/(2.4\times10^9)/4=3\times10^{-2}$(m).

Moreover, it is preferable to set the interval between upper side 10*a* and auxiliary element 15 to be 1 mm or more in order to enlarge the resonance and increase the gain by auxiliary element 15.

Although bow tie slot 11 in the embodiment of FIG. 1 has the shape in which the top parts of two isosceles triangles are opposed to join to each other, the shape of bow tie slot 11 may be that in which two diamonds are arranged or that like a mathematical symbol indicative of the infinity ∞.

Figure 5:
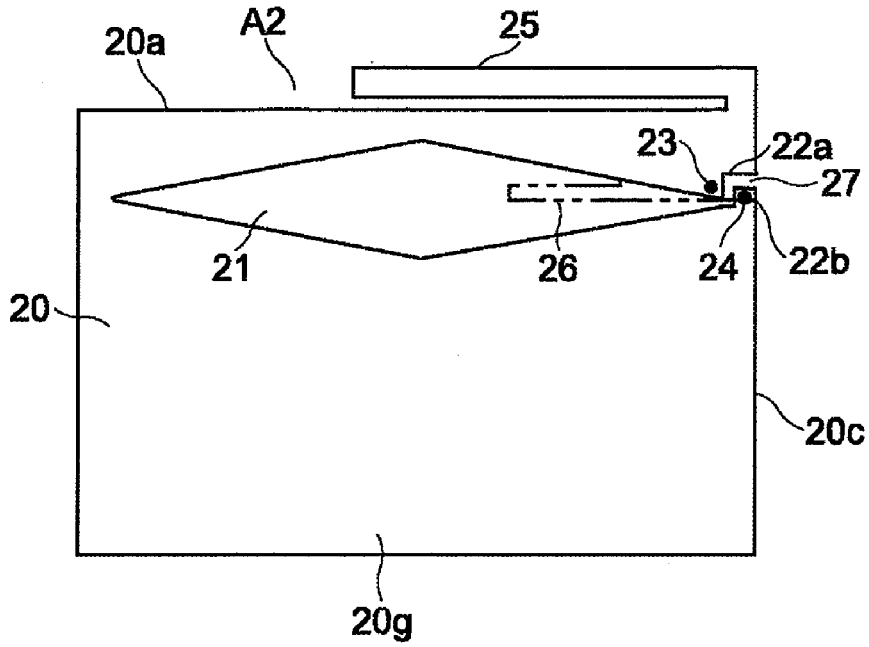
FIG. 5 is a schematic view showing the structure of an antenna according to another embodiment of the present invention.

FIG. 5 shows another embodiment of the present invention.

A further miniaturization of the bow tie slot is necessary for use in note type personal computer because the length of bow tie slot 11 becomes long to obtain the resonance of the lower frequency though the example in which bow tie slot 11 is formed in conductive plate 10 is shown in the above-mentioned embodiment.

It becomes possible to miniaturize further an antenna by dividing the antenna shown in FIG. 1 almost at the center in this embodiment.

That is, antenna A2 is formed as shown in FIG. 5. A metallic plate such as the copper alloys is stamped out with the press etc. to form rectangular conductive plate 20. Next, deformed slot 21 which is almost diamond-shape is formed in the rectangular conductive plate 20, and Notch slit 27 of reverse-L character is formed from lateral angle parts 22*a*, 22*b* of the deformed slot to vertical side 20*c* of rectangular conductive plate 20. Feeding part 23 is formed at lateral angle part 22*a*, which is one of lateral angle parts that oppose to each other through notch slit 27, and grounding part 24 is formed at lateral angle part 22*b*, which is the other one. Auxiliary element 25 is formed so as to rise up vertically at an end portion of upper side 20*a* on the side of feeding part 23, and then extend along upper side 20*a* of conductive plate 20 with a constant space being kept.

Moreover, auxiliary antenna element 26 is formed in deformed slot 21, which extends from lateral angle part 22*a* on the side of feeding part 23 to deformed slot 21, as shown by an alternate long and two short dashes line This diamond-shaped deformed slot 21 is formed on the side of upper side 20*a* of rectangular conductive plate 20. Moreover, the grounding region 20*g* with the area larger than the region above the deformed slot 21 is formed on the downside of rectangular conductive plate 20.

Notch slit 27 is formed like reverse-L character so that both lateral angle parts 22*a* and 22*b* may be arranged sideways to each other. As a result, because a coaxial cable (not shown) is in a direction perpendicular to vertical side 20*c* when connected, and leaves a space to grounding region 20*g*, the coaxial cable never influence antenna characteristics.

Figure 6:
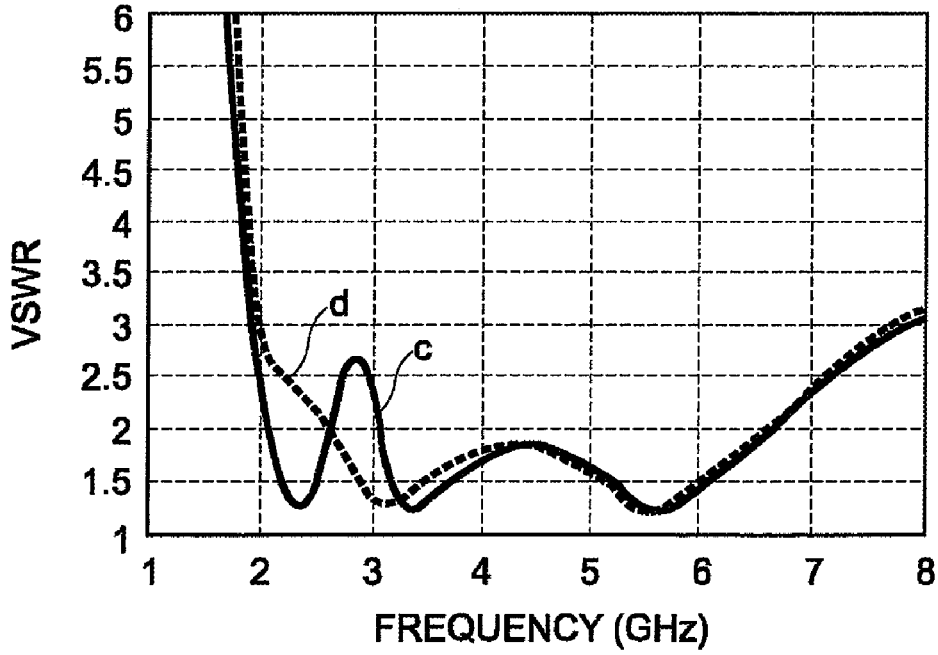
FIG. 6 is a graph showing a VSWR characteristic of the antenna shown in FIG. 5.
Figure 7:
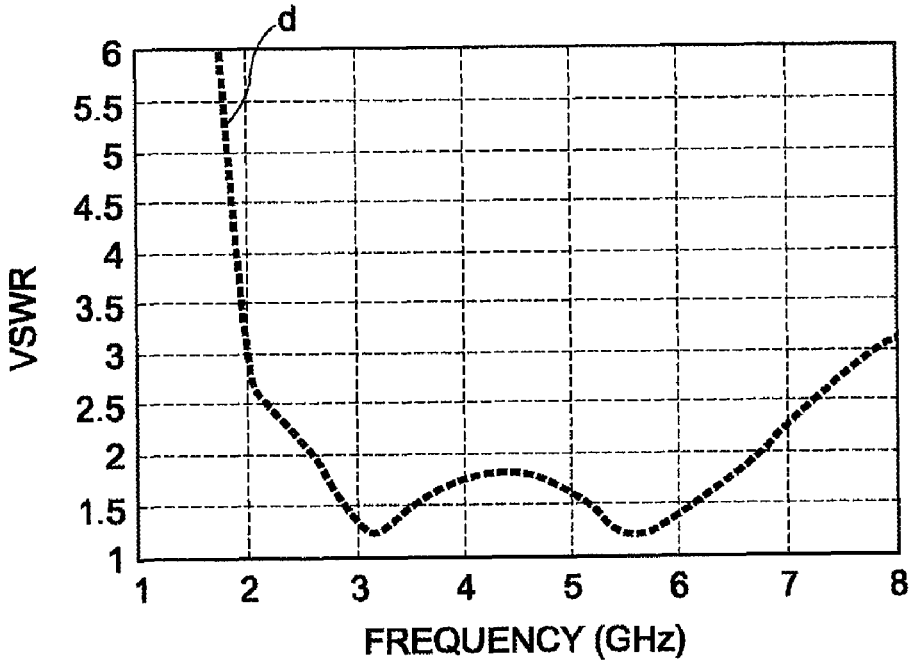
FIG. 7 is a graph showing a VSWR characteristic of an antenna in which a auxiliary antenna element is detached from the antenna of FIG. 5.

FIG. 6 and FIG. 7 show the VSWR characteristic of antenna A2 shown in FIG. 5.

VSWR characteristic d given by diamond-shaped deformed slot 21 and auxiliary antenna element 26 provides ones as shown in FIG. 7, in which 3 to 4 GHz resonance is provided by deformed slot 21 and 5 to 6 GHz resonance by auxiliary antenna element 26. Antenna A2 which shows VSWR characteristic c with a new resonance around 2.3 GHz as shown in FIG. 6 is provided by adding auxiliary element 25 to conductive plate 20.

It is originally not required to resonate as an antenna if there is no system of which use frequency resides in this area though an adjacent VSWR of about 2.8 GHz rises due to this new resonance.

That is, there are already IEEE802.11b/9 (so-called wireless LN) and IEEE802.16e (so-called WiMAX), etc. or they are scheduled to be used in 2.3 to 2.5 GHz for the future. However, the frequency band of 2.6 to 3 GHz need not be covered in the antenna intended for a mobile equipment in the future.

Therefore, there is no problem on practical use even if the VSWR characteristic deteriorates in this frequency band.

It is understood from this embodiment that the VSWR characteristic of 2.3 GHz band is greatly improved by adding auxiliary element 25.

Although a new resonance is given to the low frequency side with auxiliary element 25 in this embodiment, the present invention should not be limited to this embodiment. A new resonance besides the resonance due to a bow tie slot can be given by changing the resonance length of auxiliary element 25 in each frequency band.

Figure 8:
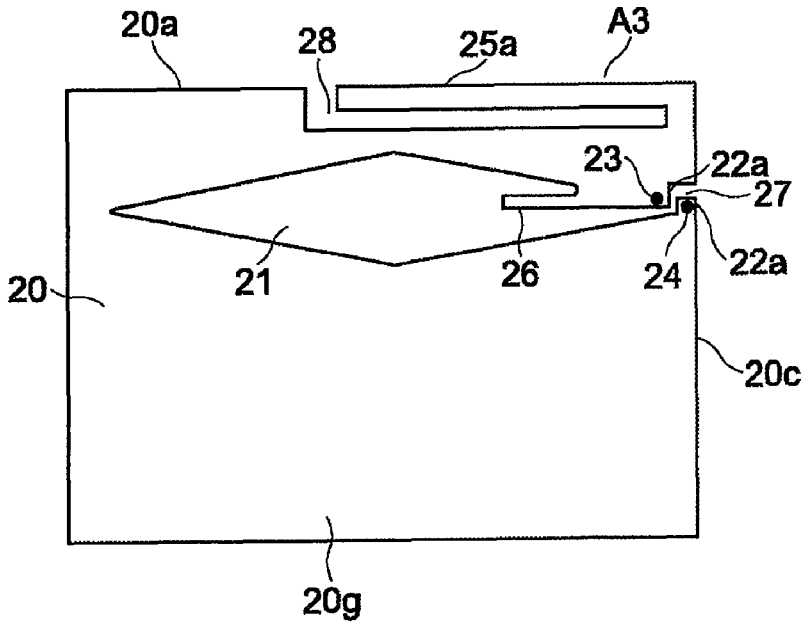
FIG. 8 is a schematic view showing the structure of an antenna according to a further embodiment of the present invention.

FIG. 8 shows a further embodiment of the present invention.

Although auxiliary element 25 is formed so as to rise up vertically at an end portion of upper side 20*a*, and then extend along the upper side with a constant space being kept in the embodiment shown in FIG. 5, auxiliary element 25*a* is formed in the upper side part of conductive plate 20 by forming hooked notch slit 28 substantially from the center part of upper side 20*a* of conductive plate 20 toward vertical side 20*c* on the side where feeding part 24 is formed in the embodiment shown in FIG. 8.

The area of a grounding region for auxiliary element 25*a* can be enlarged like this by forming auxiliary element 25*a* by providing hooked notch slit 28.

Generally, in the bow tie slot antenna, the larger a surrounding metal region (grounding region) is, the larger both the resonance and the gain become. The gain of antenna A3 shown in FIG. 8 increases more than one of antenna A2 shown in FIG. 5 because a grounding region to deformed slot 21 can be enlarged more than a grounding area to deformed slot 21 of antenna A2.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments, which can be embodied within a scope encompassed and equivalent thereof with respect to the feature set out in the appended claims.

What is claimed is:

1. An antenna comprising:

a rectangular conductive plate having a major planar side bounded by multiple minor edges, a bow tie slot formed in the major planar side of said rectangular conductive plate, an auxiliary element extended from a minor edge of the multiple minor edges of said rectangular conductive plate above one of two vertical angle parts opposed at a center part of the bow tie slot, wherein the auxiliary element is not provided within a perimeter of the bow tie slot, wherein the auxiliary element develops a resonance peak, and wherein the auxiliary element is integrally formed from a same metallic plate as the rectangular conductive plate, a feeding part formed at one of the vertical angle parts, and a grounding part formed at the other vertical angle part.

2. An antenna according to claim 1, wherein said auxiliary element is formed so as to rise up vertically around the center of an upper minor edge of the multiple minor edges of said conductive plate, and extend along said upper minor edge with a constant space being kept.

3. An antenna according to claim 1, wherein said rectangular conductive plate, said bow tie slot and said auxiliary element are formed by stamping out a metallic plate.

4. An antenna according to claim 1, comprising:

an auxiliary antenna element extended along the bow tie slot, which is formed on the side of at least one of said vertical angle parts that oppose at the center part of the bow tie slot.

5. An antenna comprising:

a rectangular conductive plate having a major planar side bounded by multiple minor edges, a slot formed in the major planar side of said rectangular conductive plate, a notch slit formed from said slot to a vertical minor edge of the multiple minor edges of the rectangular conductive plate, two feed points comprising a feeding part and a grounding part, wherein said feeding part is formed at one side of said notch slit and said grounding part is formed at the other side of said notch slit, and an auxiliary element formed on an upper minor edge of the multiple minor edges of the conductive plate in which said feeding part is formed, wherein the auxiliary element is not provided within a perimeter of the slot, and wherein the auxiliary element develops a resonance peak.

6. An antenna according to claim 5, wherein said slot is tapered or formed like a diamond, and is located on an upper portion of the rectangular conductive plate.

7. An antenna according to claim 5, wherein said auxiliary element is formed so as to rise up vertically at an end portion of the upper minor edge on the side of said feeding part, and extend along said upper minor edge of the conductive plate with a constant space being kept.

8. An antenna according to claim 5, wherein said auxiliary element is formed in the upper minor edge of the conductive plate by forming a hooked notch slit substantially from a center part of the upper minor edge of the conductive plate toward a vertical minor edge on the side where said feeding part is formed.

9. An antenna according to claim 5, wherein an auxiliary antenna element extended along said slot is formed on one of the sides of said notch slit.

10. An antenna according to claim 1, wherein a frequency of the resonance peak developed by the auxiliary element is different from a resonance frequency of the bow tie slot.

11. An antenna according to claim 1, wherein a frequency of the resonance peak can change independent of a resonance frequency of the bow tie slot, by changing a length of auxiliary element.

12. An antenna according to claim 5, wherein a frequency of the resonance peak developed by the auxiliary element is different from a resonance frequency of the bow tie slot.

13. An antenna according to claim 5, wherein a frequency of the resonance peak can change independent of a resonance frequency of the bow tie slot, by changing a length of auxiliary element.

14. An antenna comprising:

a rectangular conductive plate having a major planar side bounded by multiple minor edges, a bow tie slot formed in the major planar side of said rectangular conductive plate, an auxiliary element extended from a minor edge of the multiple minor edges of said rectangular conductive plate above one of two vertical angle parts opposed at a center part of the bow tie slot, wherein the auxiliary element is not provided within a perimeter of the bow tie slot, a feeding part formed at one of the vertical angle parts, and a grounding part formed at the other vertical angle part, wherein said auxiliary element is formed so as to rise up vertically at an end portion of the upper minor edge on the side of said feeding part, and extend along said upper minor edge of the conductive plate with a constant space being kept.

15. An antenna comprising:

a rectangular conductive plate having a major planar side bounded by multiple minor edges, a bow tie slot formed in the major planar side of said rectangular conductive plate, an auxiliary element extended from a minor edge of the multiple minor edges of said rectangular conductive plate above one of two vertical angle parts opposed at a center part of the bow tie slot, wherein the auxiliary element is not provided within a perimeter of the bow tie slot, a feeding part formed at one of the vertical angle parts, and a grounding part formed at the other vertical angle part, wherein said auxiliary element is formed in the upper minor edge of the conductive plate by forming a hooked notch slit substantially from a center part of the upper minor edge of the conductive plate toward a vertical minor edge on the side where said feeding part is formed.

* * * * *